US005685962A

United States Patent [19]

Ueffinger

[11] Patent Number: 5,685,962

[45] Date of Patent: Nov. 11, 1997

[54] APPARATUS FOR SILVER RECOVERY

[75] Inventor: Gerhard Ueffinger, Weinstadt-Grossheppach, Germany

[73] Assignee: Eastman Kodak Company, Rochester, N.Y.

[21] Appl. No.: 574,832

[22] Filed: Dec. 19, 1995

[30] Foreign Application Priority Data

Dec. 21, 1994 [DE] Germany ..... 44 45 637.9

[51] Int. Cl.[6] ..... C25C 7/00; C22B 3/00

[52] U.S. Cl. ..... 204/237; 204/275; 266/101; 266/170

[58] Field of Search ..... 204/275, 237; 205/571; 266/101, 170

[56] References Cited

U.S. PATENT DOCUMENTS 3,715,291 2/1973 Bentley ..... 205/571 X
3,901,777 8/1975 Bentley ..... 205/571 X
4,069,127 1/1978 Salemi et al. ..... 204/237 X
4,111,766 9/1978 Idota et al. ..... 205/571 X
4,139,431 2/1979 Scheidegger et al. ..... 205/571
4,299,676 11/1981 Skinner et al. ..... 204/275 X
4,346,980 8/1982 Palazzolo ..... 354/322

*Primary Examiner*—Donald R. Valentine
*Attorney, Agent, or Firm*—Frank Pincelli

[57] ABSTRACT

The apparatus allows at least two film processor fixing solution tanks for black and white films with silver-based coating to be connected to a silver recovery unit. To that end, an intermediate storage tank is connected between the fixing solution tanks and the silver recovery unit. The intermediate storage tank is divided by an impervious internal partition into two chambers of equal size. The pipes connect the overflows of the fixing solution tanks to the inlets of the first chamber. Another pipe connects the outlet to the silver recovery unit. The return pipes connect the outlets of the second chamber to the inlets of the fixing solution tanks. A pipe connects the silver recovery unit to the inlet of the second chamber.

10 Claims, 1 Drawing Sheet

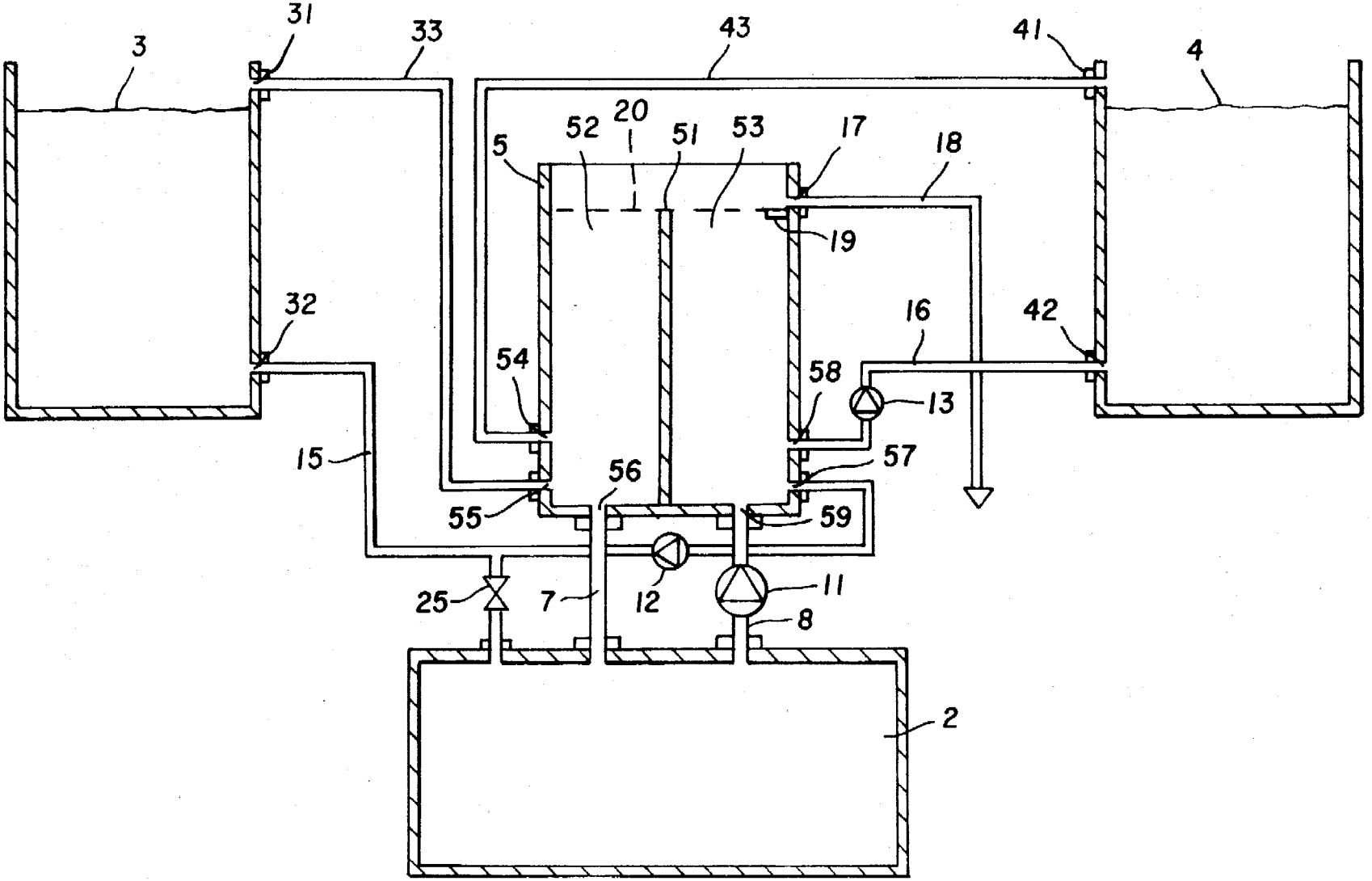
4
41
42
18
16
13
57
17
19
58
59
11
8
2
43
53
51
12
20
56
52
7
5
54
55
25
33
15
31
32
3

APPARATUS FOR SILVER RECOVERY

FIELD OF THE INVENTION

The invention involves an arrangement for connecting at least two film processor fixing solution tanks for films with a silver-based coating to a silver recovery unit, each of the luring solution tanks having an overflow and an inlet connection.

BACKGROUND OF THE INVENTION

U.S. Ser. No. 08/239,080, filed May 6, 1994 by Gerhard Ueffinger and F. Huettemeister and U.S. Pat. No. 5,451,298, issued Sep. 19, 1995 by Gerhard Ueffinger, disclose, respectively, "Method and Apparatus for Controlling Electrolytic Silver Recovery for Two Film Processors" and "Method and Apparatus for Electrolytic Silver Recovery for Two Film Processors". Those methods and apparatuses are used in the processing of black and white photographic films.

U.S. Ser. No. 08/239,080 describes an apparatus for silver-concentration-dependent control of the connection between the fixing solution tanks and the silver recovery unit. The silver concentration levels of the two fixing solutions are continuously monitored by electronic means. At any one time, one of the fixing solution tanks is connected to the silver recovery unit. If the difference between the silver concentration level in the connected and the unconnected fixing solution tanks reaches a pre-defined level, solenoid valves are opened/closed in such a way that the silver recovery unit is connected to the fixing solution tank with the higher silver concentration level. The electrolyzing current is switched on when the silver concentration exceeds a certain level and remains switched on until the silver concentration is once again below the predefined level.

The apparatus for electrolytic silver recovery for two film processors disclosed in U.S. Pat. No. 5,451,298 allows silver-concentration-dependent control of the connection between the fixing solution tanks and a silver recovery unit. Pre-defined time periods determine when the silver recovery unit is connected to one of the fixing solution tanks by means of final control elements. At the same time, variables from which the silver concentration levels can be deduced are measured by electronic means and compared with one another in such a way that the fixing solution tank having the higher silver concentration is connected to the silver recovery unit. Alternating connection of the fixing solution tanks to the silver recovery unit is effected with the aid of solenoid valves.

U.S. Pat. No. 4,346,980 also discloses a silver recovery apparatus for X-ray and photographic films. The fixing solution tank has an overflow outlet and an opening in the base of the tank. Pipes connect the two openings to a collector tank which in turn has an overflow outlet and an opening in its base connected to the silver recovery unit. Furthermore, a silver concentration sensor can be provided in the fixing solution tank. Valves are opened according to the silver concentration detected so that fixing solution can flow into the collector tank/silver recovery unit. The reconstituted fixing solution is not returned to the fixing solution tank.

SUMMARY OF THE INVENTION

It is the object of the present invention to provide a means of connecting more than one film processor fixing solution tank to a silver recovery unit and returning the reconstituted fixing solution to the connected fixing solution tanks. The type of film processor involved has no effect on the way in which the apparatus functions.

It is another object of the present invention to provide a means of connecting more than one film processor to a silver recovery unit without the use of expensive solenoid valves.

The invention achieves this by providing an intermediate storage tank between the fixing solution tanks and the silver recovery unit, by the fact that the intermediate storage tank has an impervious internal vertical partition such that the intermediate storage tank is divided into a first and a second chamber of equal size, by the fact that pipes connect the overflows of the fixing solution tanks with inlet openings in the first chamber, by the fact that a pipe connects an outlet in the first chamber with the silver recovery unit, by the fact that return pipes connect overflow outlets of the second chamber with inlets in the fixing solution tanks, and by the fact that a pipe connects the silver recovery unit to an inlet in the second chamber.

The advantages of the apparatus which is the subject of the present invention lie in the fact that expensive solenoid valves, which need to withstand a certain fluid pressure in both outflow and return directions, can be dispensed with. Doing without the solenoid valves makes the apparatus cheaper to construct since valves capable of reliably withstanding the demands placed on them in such a situation are expensive. In addition, the silver recovery apparatus in accordance with the present invention is versatile in application since different types of film processor can be connected to the electrolytic cell without having the problems with the film processor, which exerts a greater pressure, associated with a higher volume of liquid in the piping/silver recovery unit system.

In addition, if one of the film processors connected is inoperative, the fixing solution tank of that processor is kept isolated from the fluid circulation system. This ensures that the solution to be treated within the system has a higher silver concentration which in turn has a positive effect on the silver recovery rate in the silver recovery unit.

Other useful features of the invention are described in the claims.

The subject of the present invention is described below with reference to a practical example illustrated in the drawing which shows in diagram:

BRIEF DESCRIPTION OF THE DRAWING

FIG. 1 is a schematic diagram of the arrangement for silver recovery.

DETAILED DESCRIPTION OF THE INVENTION

Connected between the fixing solution tanks 3, 4 of the film processors and a silver recovery unit 2 is an intermediate storage tank 5. The fluid from the overflows 31, 41 of the fixing solution tanks 3, 4 runs into the intermediate storage tank 5 and an equal volume is returned to the fixing solution tanks 3, 4 so that continuous circulation of the solution is maintained. There is another fluid circulation system connecting the intermediate storage tank 5 and a silver recovery unit 2.

In the embodiment shown here, there are two fixing solution tanks 3, 4 of film processors (not illustrated) connected to an intermediate storage tank 5. However, it is clear to any skilled person that more than two fixing solution tanks/film processors could be connected. Similarly, effecting connection of more than two fixing solution tanks/film processors is within the capabilities of a skilled person.

The film processors contain the fixing solution tanks 3, 4. For the sake of clarity, the other tanks necessary, such as those for developing fluid and rinsing water, are not illustrated. The fluid which flows out of the overflows 31, 41 of the fixing solution tanks 3, 4 runs into an intermediate storage tank through inlets 54, 55. The inlets 54, 55 are positioned near the bottom of the intermediate storage tank 5 in order to ensure that the liquid overflowing from the fixing solution tanks 3, 4 flows into the intermediate storage tank 5 of its own accord.

The intermediate storage tank 5 is subdivided into two chambers 52 and 53 of equal size by an impervious partition 51. The inlets 54, 55 for the solution from the fixing solution tanks 3, 4 are positioned in such a way that the solution from the fixing solution tanks flows into the first of the two chambers 52. Furthermore, the first chamber has an outlet 56 which is connected to a silver recovery unit 2 by means of a pipe 7.

The second chamber 53 has an inlet 59 which gain is positioned as close as possible to the base of the intermediate storage tank 5. The silver recovery unit 2 is connected to the second chamber via a return pipe 8 to the inlet 59. A pump 11 is fitted in the return pipe 8. That pump 11 is either a separate pump which maintains the circulation of fluid described above between the silver recovery unit 2 and the intermediate storage tank 5 or a circulation pump within the silver recovery unit 2 itself which performs that function by means of a special arrangement.

The second chamber 53 has outlets 57, 58 which once again are positioned as close as possible to the base of the intermediate storage tank. The outlets 57, 58 are connected by means of pumps 12, 13 and return pipes 15, 16 to the fixing solution tanks 3, 4 of the film processors. Operation of the pumps 12, 13 enables the solution to be returned to the fixing solution tanks 3, 4. In principle, the solution can be returned to the fixing solution tanks 3, 4 at any point on the fixing solution tanks 3, 4 where there is a direct connection with the solution in the tank. A number of possible arrangements for the return pipe connection are possible via a T-joint into the circulation system of the fixing solution tanks 3, 4 or via an inlet directly into the fixing solution tank. Ideally, the return pipe inlets 32, 42 into the fixing solution tanks 3, 4 should be positioned at the overflow level with a small gap between the inlet opening and the surface of the liquid. This arrangement ensures that when the pumps 12, 13 are switched off, no liquid can flow back into the second chamber 53 of the intermediate storage tank 5. An alternative method of preventing this happening is to fit non-return valves or solenoid valves in the return pipes 15 and 16 downstream of the circulation pumps 12 and 13. The circulation pumps 12 and 13 can, for example, also be used for filling the silver recovery unit 2. To that end, one of the circulation pumps 12 or 13 in one of the return pipes 15 or 16 is operated, e.g., during installation.

An overflow 17 for the system as a whole is fitted to the intermediate storage tank 5. Ideally, that overflow is positioned roughly level with the top edge of the partition and is in the second chamber 52 of the intermediate storage tank. From the overflow 17 the excess fixing solution within the system as a whole flows along a pipe 18 into a collector tank (not illustrated) from where it is disposed of. As already mentioned above, the overflow 17 for the system as a whole is on the outer wall of the second chamber 53 which contains partially reconstituted fixing solution. Thus the fluid which flows into the collector tank for disposal is fixing solution with a reduced silver concentration.

A level sensor 19 is fitted in the intermediate storage tank 5. When the liquid in the intermediate storage tank 5 reaches a predetermined level, that level sensor generates an electrical signal which is sent to a control unit (not illustrated) and used to actuate the pumps. The signal generated when the liquid in the intermediate storage tank 5 reaches the predetermined level indicates that electrolysis in the silver recovery unit 2 can begin and that the circulation of solution between the silver recovery unit 2 and the intermediate storage tank 5 or between the intermediate storage tank 5 and the fixing solution tanks 3, 4 can begin.

The volume of the fixing solution tanks 3, 4 in film processors in which circulation-type silver recovery units 2 are used is generally over 7 liters but can be considerably more than 100 liters. The typical size for film processors used in radiography is around 10 liters and around 30 liters for those used in the graphical industry. The volume of the tanks used for the types of silver recovery units of relevance in the present context is generally over 3 liters and usually between 10 and 30 liters for units used in hospitals and the graphical industry. The rate of circulation of the fixing solution between the silver recovery unit 2 and the intermediate storage tank 5 should be at least as fast as the rate of circulation between the intermediate storage tank 5 and the two film processor fixing solution tanks 3, 4 combined. The effect of this is that the difference between the silver concentration levels in the silver recovery unit 2 and in the intermediate storage tank 5 is kept small. The rate of circulation between one of the fixing solution tanks 3 or 4 and the intermediate storage tank 5 should not be less than 1 liter/min. Otherwise, with a high film throughput rate, the silver concentration in the fixing solution tank will become too high which will then result in excessive carry-over of silver to the rinsing water which in turn might result in failure to comply with regulations limiting silver carry-over. A sensible rate of circulation between the silver recovery unit 2 and the intermediate storage tank 5 is 3 liters/min or above. The capacity of the intermediate storage tank 5 should be between 5 and 10 liters under the circumstances described above.

The following description assumes that the fixing solution tanks 3, 4 were filled when the system was installed. The second chamber 53 of the intermediate storage tank is also filled with fresh fixing solution until it reaches the level 20 of the top of the impervious partition 51 between the first chamber 52 and the second chamber 53. The return pipe 15 between the inlet 32 into the fixing solution tank 3 and the branch pipe to the valve 25 is closed off by means of a hose clamp (not illustrated). By switching on the pump 12 and opening the valve 25, the solution is pumped into the silver recovery unit 2. If the solution in the second chamber 53 is insufficient to fill the silver recovery unit 2, the second chamber 53 must be refilled with fresh fixing solution. While the silver recovery unit 2 is being filled, the bleed valve (not illustrated) on the silver recovery unit 2 must be open. Once the silver recovery unit 2 is full, the bleed valve and the filler valve 25 are closed. The hose clamp is removed and the pump 12 is switched off. Since the silver recovery unit 2 is a closed system, it can not overflow during subsequent operation.

When films are being developed, the fixing solution tanks 3, 4 are normally topped up with fresh solution according to the rate at which films are being processed. The film processing rate can, for example, be determined by a method such as that disclosed in pending patent application DE-A-42 40 433.9. This causes the liquid level in the fixing solution tanks 3, 4 to rise which causes fixing solution to overflow through the overflow outlets in the fixing solution tanks 3, 4 and nm into the first chamber 52 of the intermediate storage tank 5. Thus the level of liquid in the first chamber 52 of the intermediate storage tank 5 rises until it reaches the level of the top of the impervious partition 51 and overflows into the second chamber 53. This then results in the second chamber 53 filling up. When the liquid in the second chamber reaches a level 20 predetermined by the level sensor 19, the apparatus starts to work.

The pumps 12 and 13 are switched on. This causes fixing solution to flow back into the fixing solution tanks 3, 4 which in turn causes the fixing solution to overflow into the overflow outlets 31, 41 and into the first chamber 52 of the intermediate storage tank. The pump 11 between the silver recovery unit and the second chamber of the intermediate storage tank is also switched on, thus pumping fixing solution from the silver recovery unit 2 into the second chamber 53 of the intermediate storage tank. Depending on the delivery rate of that pump 11 in comparison with the combined delivery rates of the other two pumps 12 and 13, fixing solution will either flow over the impervious partition 51 from the first chamber 52 into the second chamber 53 or vice versa. Ideally, the delivery rate of pump 11 should be greater than the combined delivery rates of pumps 12 and 13 in the return pipes 15 and 16. The advantage of this is that only partially reconstituted fixing solution overflows into the overflow outlet 17. If the system reaches a state of equilibrium, the first chamber 52 will collect fixing solution with a higher silver concentration than in the second chamber 53. In the fixing solution tanks 3, 4 the silver diffuses into the fixing solution from the films and from there passes into the first chamber 52 of the intermediate storage tank. Partially reconstituted fixing solution will be fed into the second chamber 53 from the silver recovery unit 2 by means of the pump 11 and the pipe 8.

The overflow 17 for the system as a whole is also in the outer wall of the second chamber 53 of the intermediate storage tank. This allows excess fixing solution with a low silver content to nm off into a collector tank where it is held, ready for subsequent disposal.

The state of the art is not capable of achieving total removal of the silver content from fixing solution. The electrolyser is either switched off once the silver concentration has been reduced to a predetermined level or is turned down to a lower holding current. The particulars of the design of the electrolyser control unit are of no relevance in this regard. It is known, however, that silver recovery is more efficient if the silver concentration is higher. This means that more silver is recovered in the same amount of time with the same current or that a higher electrolyzing current can be used with a higher silver concentration. It is therefore useful to know in which film processor more film is being processed because this will mean that the fixing solution in that processor will have a higher silver concentration.

Experience has shown that, very often, of two film processors which stand side by side, one will have a much higher film throughput than the other. The apparatus which is the subject of the present invention can utilize this situation once electrolysis has reduced the silver concentration in the system as a whole to a low level. If at that point, for example, films are placed in the fixing solution in the first film processor but not in the fixing solution in the second film processor, then there is no need to switch on the pump 13 in the return pipe 16 to the second fixing solution tank 4. This means that the silver which collects in the first fixing solution tank 3 is not distributed through the system as a whole but is restricted to the intermediate storage tank 5 and the fixing solution tank 3. This also keeps the concentration level of the fixing solution higher which results in a higher silver recovery rate as described above. This advantage applies in particular if one of the film processors remains switched off (e.g. overnight). In that case, the processor which is switched off remains completely isolated from the remainder of the circulation system.

Control of the pumps 11, 12 and 13 and valves (if used) can be effected by the control unit (not illustrated) of the silver recovery unit 2 or by a separate control unit (not illustrated). The signals from the film processors indicate that they arc switched on and/or supply information on the rate of film throughput.

Although the embodiment described has only two connected film processors or fixing solution tanks, the interrelationship of the individual components make it entirely possible to connect more than two film processors at any time.

PARTS LIST

2 . . . silver recovery unit
3,4 . . . fixing solution tanks
5 . . . intermediate storage tank
7,15,16,18 . . . pipes
8 . . . return pipe
11,12,13 . . . pumps
17 . . . overflow
19 . . . level sensor
20 . . . level
25 . . . valve
31,41 . . . overflows
32,42 . . . return pipe inlets
51 . . . partition
52,53 . . . chambers
54,55 . . . inlets
56 . . . outlet
57,58 . . . outlets
59 . . . inlet

We claim:

1. Apparatus for connecting at least two film processor fixing solution tanks for films with a silver-based coating to a silver recovery unit, the fixing solution tanks each having an overflow and an inlet, characterized in that there is an intermediate storage tank connected between the fixing solution tanks and the silver recovery unit, in that the intermediate storage tank has an internal impervious vertical partition such that the intermediate storage tank is divided into a first and a second chamber of equal size, in that pipes connect the overflows of the fixing solution tanks with inlets in the first chamber, in that a pipe connects an outlet with the silver recovery unit, in that return pipes connect outlets of the second chamber with the inlets of the fixing solution tanks, and in that a pipe connects the silver recovery unit with an inlet in the second chamber of the intermediate storage tank.

2. Apparatus in accordance with claim 1 characterized in that means are provided so that the quantities of liquid which flow from the fixing solution tanks into the first chamber of the intermediate storage tank are equal to the quantities of liquid which flow back from the second chamber to the fixing solution tanks.

3. Apparatus in accordance with claim 1 characterized in that the silver recovery unit is a closed electrolytic cell.

4. Apparatus in accordance with claim 1 characterized in that the outer of the first chamber is positioned next to the base of the intermediate storage tank.

5. Apparatus in accordance with claim 1 characterized in that the inlet of the second chamber is positioned next to the base of the intermediate storage tank and in that there is a pump in the return pipe.

6. Apparatus in accordance with claim 1 characterized in that the outlets of the second chamber are positioned next to the base of the intermediate storage tank and in that each of the return pipes from the second chamber to the fixing solution tanks is fitted with a pump.

7. Apparatus in accordance with claim 6 characterized in that non return valves are fitted in the return pipes downstream of the pumps.

8. Apparatus in accordance with claim 1 characterized in that the inlets in the first chamber are positioned in such a way relative to the fixing solution tank overflows that liquid flows from the fixing solution tank overflow outlets into the first chamber of its own accord.

9. Apparatus in accordance with claim 1 characterized in that the second chamber has an overflow through which partially reconstituted fixing solution can flow along a pipe into a collector tank for disposal.

10. Apparatus in accordance with claim 1 characterized in that a level sensor is fitted in the second chamber, said level sensor generating a signal which is used for the purposes of controlling the pumps in the return pipes.

* * * * *